United States Patent [19]

Eiff

[11] 4,198,005

[45] Apr. 15, 1980

[54] CUTTING MILL

[75] Inventor: Peter Eiff, Reutlingen, Fed. Rep. of Germany

[73] Assignee: Bruderhaus Maschinen GmbH, Reutlingen, Fed. Rep. of Germany

[21] Appl. No.: 809,655

[22] Filed: Jun. 24, 1977

[30] Foreign Application Priority Data

Jul. 17, 1976 [DE] Fed. Rep. of Germany ..... 2632330

[51] Int. Cl.[2] ..... B02C 13/04

[52] U.S. Cl. ..... 241/73; 241/285 B

[58] Field of Search ..... 241/221-222, 241/285 A, 285 B, 73

[56] References Cited

U.S. PATENT DOCUMENTS

| | | | |
|---|---|---|---|
| 672,951 | 4/1901 | Merrick | 241/285 R UX |
| 672,952 | 4/1901 | Merrick | 241/285 A UX |
| 1,602,622 | 10/1926 | London | 241/285 B UX |
| 3,360,204 | 12/1967 | Merges et al. | 241/285 B X |
| 3,419,223 | 12/1968 | Morin | 241/73 |
| 3,756,519 | 9/1973 | Reynolds | 241/73 |

FOREIGN PATENT DOCUMENTS 2019384 11/1971 Fed. Rep. of Germany ..... 241/285 A

*Primary Examiner*—Howard N. Goldberg
*Attorney, Agent, or Firm*—Wigman & Cohen

[57] ABSTRACT

A cutting mill is disclosed which comprises a housing formed of upper and lower pivotally related housing parts in which a rotor carrying cutting tools is disposed along a horizontal axis. Stator cutting tools are mounted within the housing for coaction with the rotor cutting tools and a sieve is removably mounted in the lower housing part. The rotor is mounted in bearings which are selectively carried by the upper housing part or the lower housing part when such parts are pivoted relative to each other to permit (1) replacement of the sieve when the rotor with its bearings are carried by the upper housing part or (2) accessibility for adjustment of the stator cutting tools in the upper housing part when the rotor and bearings are retained in the lower housing part.

5 Claims, 4 Drawing Figures

CUTTING MILL

BACKGROUND OF THE INVENTION

The present invention relates to a cutting mill having a horizontally arranged rotor carrying cutting tools. The rotor is enclosed within a housing comprising lower and upper housing parts which form a cutting chamber. The housing carries stator cutting tools which interact with the rotor cutting tools. The upper part of the housing is connected to the lower part so that it can be hinged out of the way about an axis parallel to the axis of the rotor. A sieve is exchangeably located in the lower housing part.

Known cutting mills of this general type present several disadvantages by reason of the location of the rotor in the lower part of the housing. The invention disclosed in U.S. patent application, Ser. No. 728,116 filed Sept. 30, 1976 now U.S. Pat. No. 4,073,444, the disclosure of which is incorporated herein by reference, is based on the task of providing a cutting mill of the above-mentioned type which eliminates these disadvantages and in which cutting mill the necessary exchange, assembly and operational work can be carried out rapidly and without the danger of injury. According to the invention disclosed in the aforesaid application, this task is solved by mounting the rotor to the upper part of the housing. After the construction of the cutting mill according to the above, a disadvantage of this construction was observed that did not exist in the known cutting mills of the type having the rotor located in the lower housing part. This disadvantage consists in the fact that the stator cutting tools in the upper housing part are only accessible through openings provided in the upper housing part which are closed by flaps and, even then, are only accessible to a limited extent because the rotor prevents direct access from beneath the upper housing part.

SUMMARY AND OBJECTS OF THE INVENTION

The present invention is, therefore, based on the task of providing a cutting mill of the above-mentioned type having a rotor located in the upper housing part and constructed to eliminate the aforementioned disadvantage by providing stator cutting tools which are made accessible as simply and easily as possible.

The invention proceeds from a cutting mill according to the aforementioned U.S. patent application Ser. No. 728,116, now U.S. Pat. No. 4,073,444, which cutting mill is provided with two spacing elements located adjacent to the sides of the rotor, which elements form the lateral boundary walls of the cutting chamber and are each provided with a circular-cylindrical surface comprising a contact surface for the sieve. The task is solved, according to the present invention, by the fact that each spacing element consists of two sector-shaped disks which form a circular ring and which support half of a bearing flange of the rotor or half of the rotor shaft. Each of these disks is located in one of the two halves of the housing or housing parts, and the upper disk is mounted in the upper housing part. The bearing flanges of the rotor are each detachably connected with the upper housing part. This, in a surprisingly simple way, permits the location of the rotor in the upper housing part according to the prior application with its advantages, but, on the other hand, without being subject to its disadvantages. By reason of the detachable connection of the two bearing flanges of the rotor with the upper housing part, such upper housing part can, after the disconnection of the bearing flanges, be hinged out of the way in an upward direction without the rotor which, together with its bearing flange, remains with the lower housing part. In this case, the stator cutting tools in the upper housing part are readily accessible without any difficulty. In the normal case, the detachable connection of the two bearing flanges of the rotor with the upper housing part is maintained connected, so that when the upper housing part is hinged out of the way, the rotor follows and the advantages of the cutting mill of the prior application are present.

In the case of a preferred embodiment of the cutting mill according to the present invention, the two lower disks are each attached at one of the bearing flanges of the rotor. The result is that when the upper housing part, together with the rotor is hinged out of the way, the lower disks will be carried thereby and free the sieve located in the lower housing part so that it can be exchanged easily.

In order to insure a secure mounting of the rotor at the lower housing part when the upper housing part is pivoted without the rotor, a step in the bearing flange and the lower disk associated with such flange, forms a receptacle for the lower part of the housing, according to the preferred embodiment.

The preferred embodiment also includes two quick-acting clamping devices for the detachable connection of the two bearing flanges with the upper housing part at its apex. These devices make it possible to simply and rapidly secure or detach the aforementioned connection. It is advantageous that each quick-acting clamping device have a threaded bolt which is hinged at the associated bearing flange, a laterally protruding receptacle at the upper housing part for the reception of the threaded bolt and a threaded-on nut. Such quick-acting clamping devices per se are conventional.

BRIEF DESCRIPTION OF THE DRAWINGS

In the following, the present invention is explained in detail by means of a preferred embodiment shown in the drawings, wherein.

DETAILED DESCRIPTION OF A PREFERRED EMBODIMENT

Figure 1:
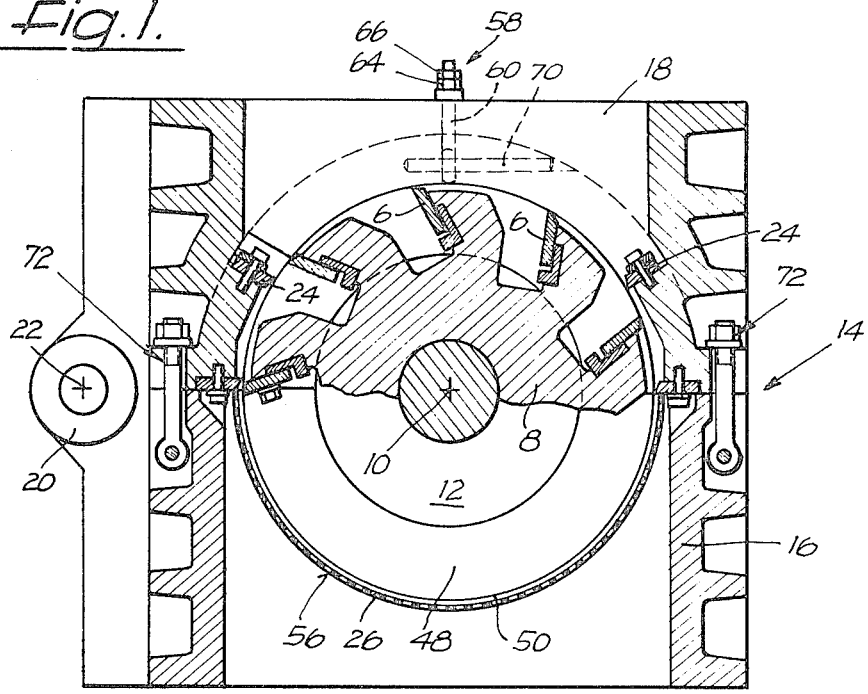
FIG. 1 shows a central cross-section through the closed housing, the upper half of the rotor and the sieve of the cutting mill.
Figure 2:
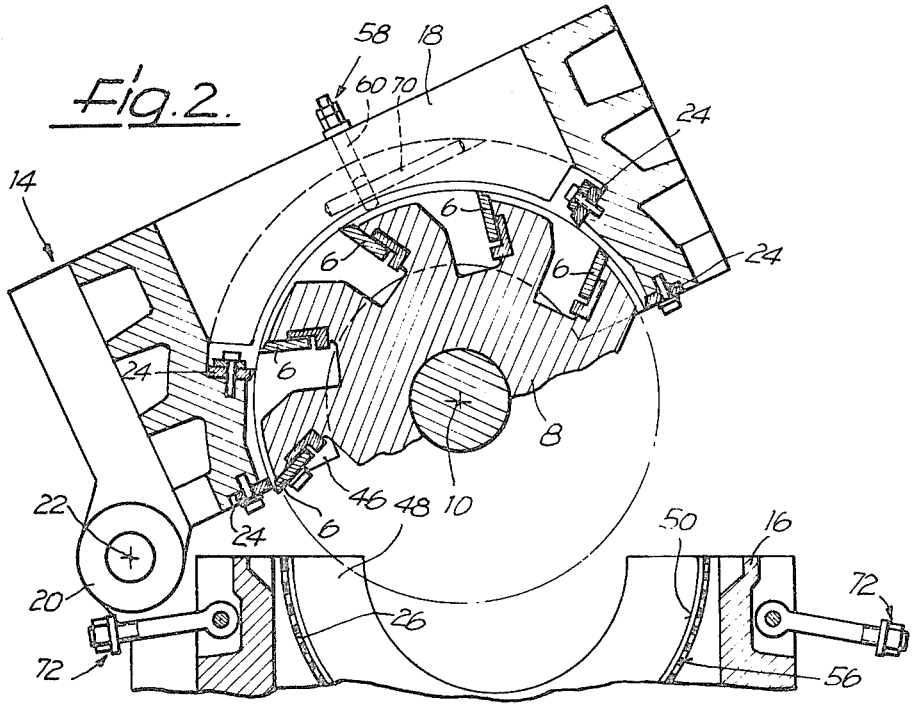
FIG. 2 shows a corresponding fragmentary central cross-section through the opened housing, the upper half of the rotor and the sieve of the embodiment with the rotor hinged out of the way in the upper housing part.

Referring to the drawings, the preferred embodiment of the cutting mill according to the present invention consists essentially of a rotor 8 having a horizontal axis 10 about which are located cutting tools 6 and a housing 14 forming a cutting chamber 12. The housing 14 has an upper housing part 18 and a lower housing part 16. The upper housing part 18 is connected with the lower part 16 by means of at least one joint or hinge 20 so that it can be pivoted about an axis 22 which is parallel to the axis 10 of the rotor 8. This upper part 18 also carries stator cutting tools 24 which interact with the rotor cutting tools 6. In addition, the preferred embodiment has a sieve 26 which is exchangeably located in the lower housing part 16. Since a number of the characteristics of the cutting mill construction are neither shown nor described herein, reference is made to the description of a construction example of a cutting mill according to U.S. patent application, Ser. No. 728,116, filed Sept. 30, 1976, now U.S. Pat. No. 4,073,444. Such cutting mill is also shown in West German Patent Specification DT-OS No. 2 544 496.

Figure 3:
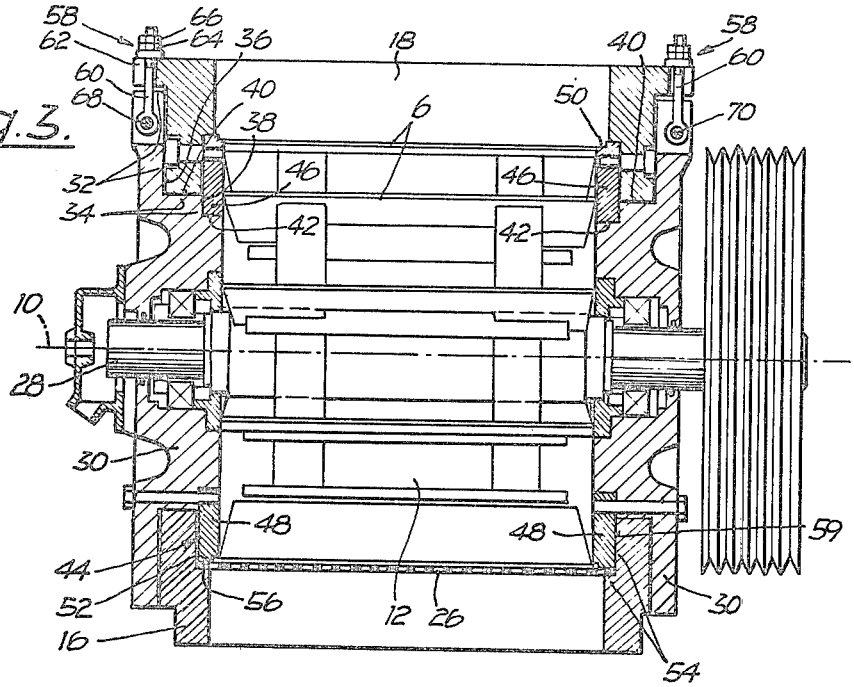
FIG. 3 shows a central longitudinal section through the cutting mill of FIG. 1.
Figure 4:
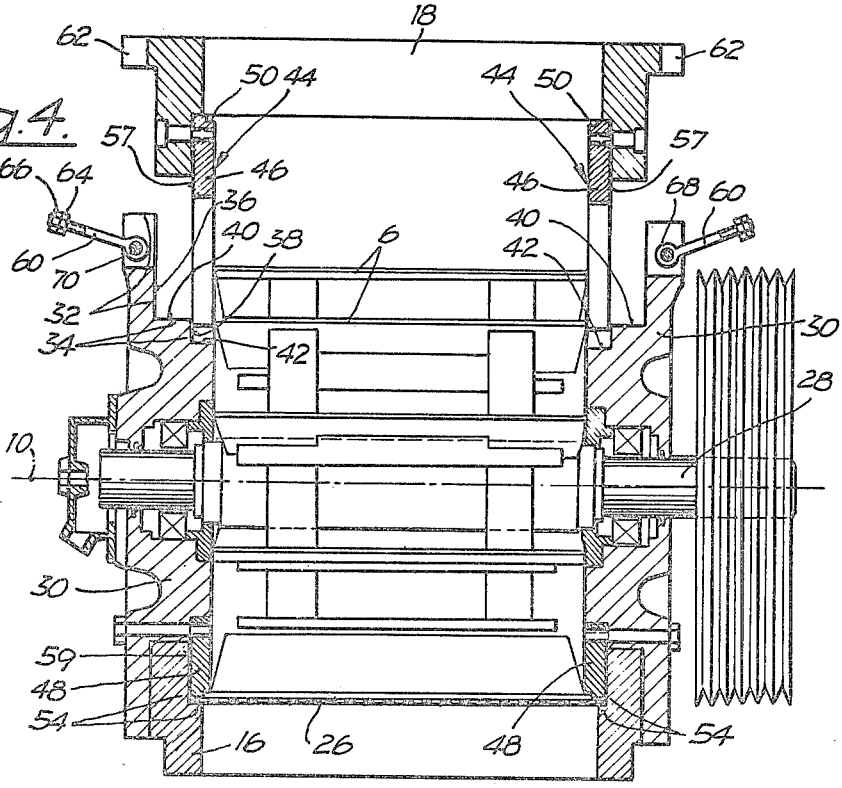
FIG. 4 shows a corresponding central longitudinal section through the opened housing with the rotor and the sieve remaining in the lower housing part.

The rotor 8 has a shaft 28 which can be driven. Both ends of the shaft are journaled in two essentially identically constructed bearing flanges 30 (FIG. 3). Each of the bearing flanges 30 has two ring-shaped or annular steps or shoulders 32 and 34 which form three axially successive flange sections with two parallel outer shoulders 36 and 38 located in radial planes transverse to the rotor axis as well as two cylindrical surfaces 40 and 42. Adjacent the front sides of the rotor 8, two subdivided spacing elements 44 (FIG. 4) are located as lateral boundary walls of the cutting chamber 12. Each spacing element 44 consists of two sector-shaped disks 46 and 48 which form a circular ring and which support half of each of the bearing flanges 30 of the rotor 8. Each of these disks 46 and 48 is located in one of the two halves of the housing which comprise the housing parts 16 and 18. The upper disks 46 are mounted to the upper housing 18 whereas the lower disks 48 are not mounted to the lower housing part 16, but rather at the rotor bearing flange 30 associated with each disk 48. The upper disks 46 have a stop face 50 for the stator cutting tools 24 in the upper housing part 18. These stop faces 50 are formed by the circular-cylindrical surfaces of an annular step at the circumference of each of the upper disks 46. Each lower disk 48 is provided with a stop face 52 which has the form of a circular-cylindrical surface coaxial to the axis 10 of the rotor and which, according to the desired gap between the rotor cutting tools 6 and the circular-cylindrical sieve 26 protrudes beyond the circumference at the flight of the blades of the rotor cutting tools. The edges of the sieve 26 rests against the circular-cylindrical surface of the stop faces 52. These edges of the sieve 26 are supported by circular-cylindrical support surfaces 56 which are formed by steps 54 at the sides of the lower housing part 16.

Each disk 46 or 48 of the two spacing elements 44, with its radially interior edge rests against a shoulder 38 of a respective bearing flange 30 and against the interior cylindrical surface 42 of the flange 30. Each of the upper disks 46 is bolted to the upper housing part 18 which extends between the shoulder 36 of the associated bearing flange 30 and the adjacent surface 57 of the upper disk 46 to the cylindrical surface 40 in a space-filling manner. Each of the lower disks 48 is bolted from outside the lower housing part 16 with its respective bearing flange 30. According to the construction at the upper housing part 18, the lower housing part 16 extends, also in a space-filling manner, between the shoulder 36 of each bearing flange 30 and the adjacent surface 59 of the respective lower disk 48 to the cylindrical surface 40. At least at locations where necessary, the bolt fastenings are concealed.

The bearing flanges 30 of the rotor 8 are each detachably connected with the upper housing part 18. Two quick-acting clamping devices 58 for the detachable connection of the two bearing flanges 30 with the upper housing part 18 at its apex, each have a threaded bolt 60 which is hinged at its associated bearing flange, a laterally protruding receptacle or slot 62 which receives the bolt 60 at the upper housing part 18 and a threaded-on nut 66 with a washer 64. The unthreaded end of the bolt 60 has an eye 68, which is located on a pin 70 located in the portion of the bearing flange 30 disposed in the upper housing part 18 above the axis 10 of the rotor 8. The receptacle or slot 62 against which the nut 64 is tightened, is fork-shaped, so that the bolt 60 after loosening the nuts 64 can be swivelled out of the slots. Two quick-acting clamping devices 72 which correspond to the two quick-acting clamping devices 58 are also provided in front of and behind the rotor 8 at the housing 14, so that the two housing parts 16 and 18, after the hinging down of the upper housing part 18 onto the lower housing part 16, can be connected with each other in a detachable manner.

The described construction makes it possible to locate the rotor 8, which, by means of its bearing flange and the two quick-acting clamping devices 58 is carried by the upper housing part 18, if desired, at the lower housing part 16 by means of the quick-acting clamping devices 58 which can be disconnected by loosening the nuts 64 and laterally swivelling away the bolts 60. The result is that, when the upper housing part 18 is hinged out of the way, the rotor is not carried by it, but remains, with its bearing flanges 30, in the lower housing part 16.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. A cutting mill comprising a housing having upper and lower parts forming a cutting chamber, a rotor having rotor cutting tools mounted thereon and rotatably mounted in said housing on an axis, stator cutting tools mounted in said upper housing part and operatively cooperating with said rotor blades, means pivotably mounting said upper and lower housing parts about an axis substantially parallel to said rotor axis, a sieve removably mounted in the lower housing part, bearing means arranged in said housing at each end of said rotor for rotatably supporting said rotor and means detachably connecting said bearing means with said upper housing part for selectively locating said rotor in either of said upper housing part or said lower housing part upon pivoting said upper and lower housing parts relatively of each other between a closed and an open position, thereby permitting access to said sieve and rotor parts for maintenance, said bearing means includes a bearing flange arranged at each end of the rotor, spacing elements arranged adjacent each bearing flange of the rotor and forming lateral walls of said cutting chamber, said spacing elements including arcuate stop surfaces bearing against the sieve when said housing parts are in the closed position, each of said spacing elements further comprising upper and lower arcuate plates which together define a split circular ring supporting a respective bearing flange.

2. The cutting mill according to claim 1, wherein said lower arcuate plates are mounted to a respective bearing flange.

3. The cutting mill according to claim 2, wherein said bearing flanges each include a stepped portion which, together with a respective lower arcuate plate, define a recess for receiving a portion of the lower housing part.

4. The cutting mill according to claim 1, wherein said upper arcuate plates are secured to said upper housing part, said detachably connecting means further comprising clamping means mounted to a respective bearing flange for the detachable connection of said bearing flange with the upper housing part.

5. The cutting mill according to claim 4, wherein said upper housing part has an apex, said clamping means comprising a threaded bolt pivotally mounted to a respective bearing flange, nuts threaded onto said bolts, lateral slots in said upper housing part adjacent the apex thereof for receiving said threaded bolts when said bolts are pivoted about their mounting on said bearing flanges.

* * * * *